US005423404A

United States Patent [19]

Shaw

[11] Patent Number: 5,423,404

[45] Date of Patent: Jun. 13, 1995

[54] TRIPLE SECTION ZIPPER TOOL CASE

[75] Inventor: John R. Shaw, Greenfield, Ind.

[73] Assignee: C. H. Ellis Company, Inc., Indianapolis, Ind.

[21] Appl. No.: 190,282

[22] Filed: Feb. 2, 1994

[51] Int. Cl.[6] ..... A45C 13/00

[52] U.S. Cl. ..... 190/102; 190/109; 190/111; 206/372

[58] Field of Search ..... 206/372, 373, 320, 315.1; 190/102, 103, 109, 111, 113, 119

[56] References Cited

U.S. PATENT DOCUMENTS

| | | | |
|---|---|---|---|
| D. 329,329 | 9/1992 | Bomes et al. . | |
| 469,138 | 2/1892 | Harper . | |
| 2,561,707 | 7/1951 | Miller . | |
| 3,122,225 | 2/1964 | Ward | 190/109 |
| 3,259,230 | 7/1966 | Jaeger . | |
| 4,210,186 | 7/1980 | Belenson | 190/111 |
| 4,285,556 | 8/1981 | Loeffel . | |
| 4,691,469 | 9/1987 | Alsobrook et al. . | |
| 4,693,346 | 9/1987 | Eversdijk . | |
| 4,793,508 | 12/1988 | Thompson . | |
| 4,805,748 | 2/1989 | Gerch | 190/109 |
| 4,805,749 | 2/1989 | Gerch | 190/111 |
| 4,817,802 | 4/1989 | Pratt | 206/315.1 |
| 4,830,154 | 5/1989 | Gerch et al. . | |
| 4,832,193 | 5/1989 | Kime . | |
| 4,874,119 | 10/1989 | Winter . | |
| 4,961,522 | 10/1990 | Weber | 190/119 |
| 5,002,401 | 3/1991 | Blackman . | |
| 5,005,679 | 4/1991 | Hjelle | 190/111 |
| 5,052,555 | 10/1991 | Harmon . | |
| 5,105,919 | 4/1992 | Bomes et al. . | |
| 5,109,961 | 5/1992 | Bergman | 190/111 |
| 5,117,883 | 6/1992 | Chen | 190/119 |
| 5,152,441 | 10/1992 | Torena . | |
| 5,265,719 | 11/1993 | Wand | 190/111 |
| 5,267,679 | 12/1993 | Kamaya et al. | 190/102 |

FOREIGN PATENT DOCUMENTS

| | | | |
|---|---|---|---|
| 482006 | 3/1938 | United Kingdom | 190/119 |

*Primary Examiner*—David T. Fidei
*Attorney, Agent, or Firm*—Barnes & Thornburg

[57] ABSTRACT

A triple section tool case includes a center cargo bay and two outer sections. One of the outer sections has built-in tool-receiving compartments and the other of the outer sections is a slim-line attache case. The cargo bay is opened and closed by means of a dual zipper and hook and loop connector flap.

19 Claims, 2 Drawing Sheets

TRIPLE SECTION ZIPPER TOOL CASE

BACKGROUND AND SUMMARY OF THE INVENTION

The present invention relates to a tool case for carrying tools and other items to a work site. More particularly, the present invention relates to a tool case that includes multiple cargo sections.

Tradesmen use a variety of tools to perform the work of their trade (e.g., carpenter, appliance repair, electrician, painter, insulator). Tradesmen use tool cases to transport their tools to and from each work site. Different work sites require different tools to complete the necessary work. Therefore, it is important that the tradesmen be able to transport many tools to each work site. Tradesmen may also require items other than tools to perform their work such as office supplies, calculator, business cards, change of clothes, food, computer, clipboard, floppy disks, cellular phone, tape recorder, umbrella, etc . . .

What is needed is a tool case that allows a tradesman to carry tools and other necessary items in an organized manner. It would also be desirable to have access to separate compartments within the tool case without exposing the contents of the entire tool case.

According to the present invention, a triple section zipper tool case is provided to transport tools and other necessary items. The tool case includes a central cargo bay and two outer pockets. The central cargo bay includes a top side, a bottom wall opposite of the top side, first and second end walls appended to the bottom wall and situated opposite of each other, and first and second side walls appended to the bottom wall. The first and second side walls are situated opposite of each other and arranged to extend between first and second end walls. The first and second side walls are substantially larger than the first and second end walls. The two outer pockets are created by attaching an outside wall to the side wall of the central cargo bay.

One feature of a tool case in accordance with the present invention is that a first outer pocket carries tools, a second outer pocket carries necessary field service documentation, and the central cargo bay carries larger miscellaneous items. The first outer pocket is an organized tool case that carries tools in tool pockets situated on the first side wall and first outside wall. The second outer pocket is a slim-line attache case that carries a clipboard, business cards, floppy disks, and other office supplies. The central cargo bay has room to transport larger tools, clothes, or any other item the tradesman needs. For example, the central cargo bay is sized to carry power tools, circuit boards, spare modules, test equipment, cables and accessories, spare parts, boxes, large service manuals, notebook computers or printers, consumables, or overnight items.

Advantageously, the outer pockets are the full width and length of the side wall of the central cargo bay. This maximizes the space available to transport items in the outside pockets.

Another feature of a tool case in accordance with the present invention is that each of the central cargo bay and two outside pockets include their own fasteners. Providing separate access to each cargo bay and pocket makes the tool case easier to use and does not expose all items to the environment every time the tool case is opened.

In preferred embodiments of the present invention, the central cargo bay is accessed by unfastening a single flap that extends from the first end wall along the entire length of the top side to the second end wall. This creates a large opening into the central cargo bay and thus allows easy loading and unloading of items into the central cargo bay.

Advantageously, the single central cargo bay flap is easily fastened and unfastened using a dual zipper and hook and loop fastener. The dual zipper includes two zippers situated on opposite sides of the single flap and arranged to extend parallel to each other along the entire length of the flap. The flap is permanently attached to the first end wall and is attached to the second end wall by means of a hook and loop fastener.

Also in preferred embodiments of the present invention, the two outer pockets pivot with respect to the center cargo bay. The outside walls that form the outer pockets are permanently attached to the center cargo bay along the bottom of the side walls and are fastened along the other sides of the center cargo bay using zippers. Permanently attaching the outside wall to only one side of the central cargo bay allows a wide range of motion for the outer pocket to pivot. This allows for easy access to the two outer pockets.

Advantageously, the two outer pockets provide protection for the center cargo bay. The extra layers of construction provide an additional barrier for the center cargo bay to reduce damage to items in the center cargo bay. This provides a more secure space to transport items.

Another feature of a tool case in accordance with the present invention is that the large central cargo bay stabilizes the tool case to prevent the tool case from "tipping over" when one or both of the outside pockets are opened. This allows for a more user-friendly tool case.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
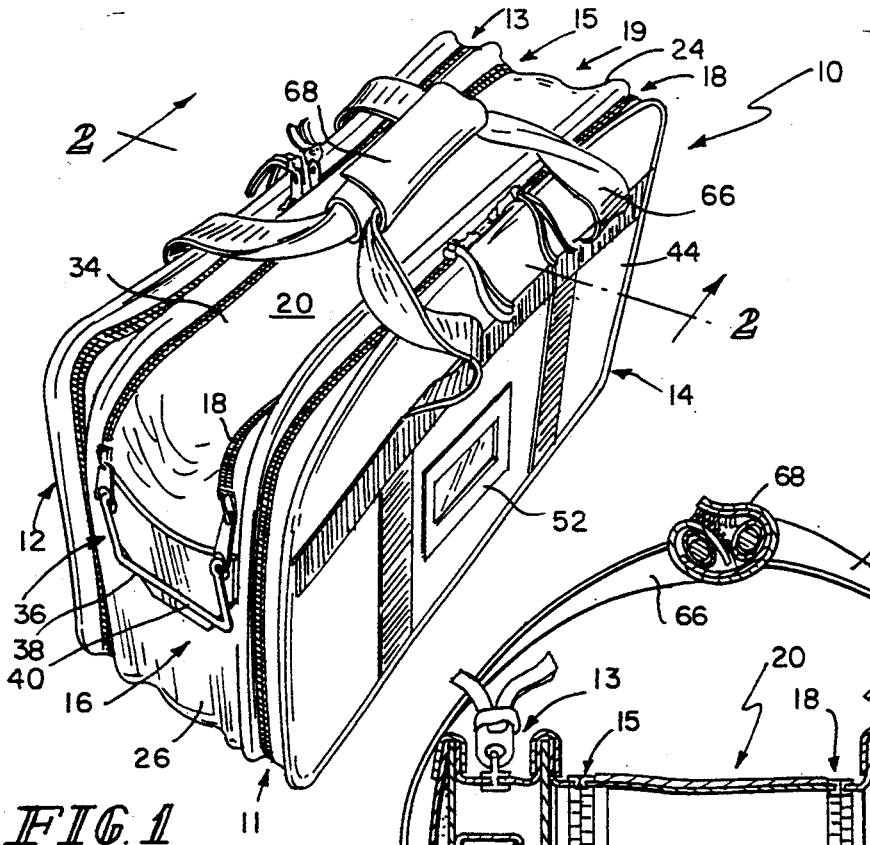
FIG. 1 is a perspective view of the tool case showing a central cargo bay and a first and second outer pocket in a closed position.
Figure 2:
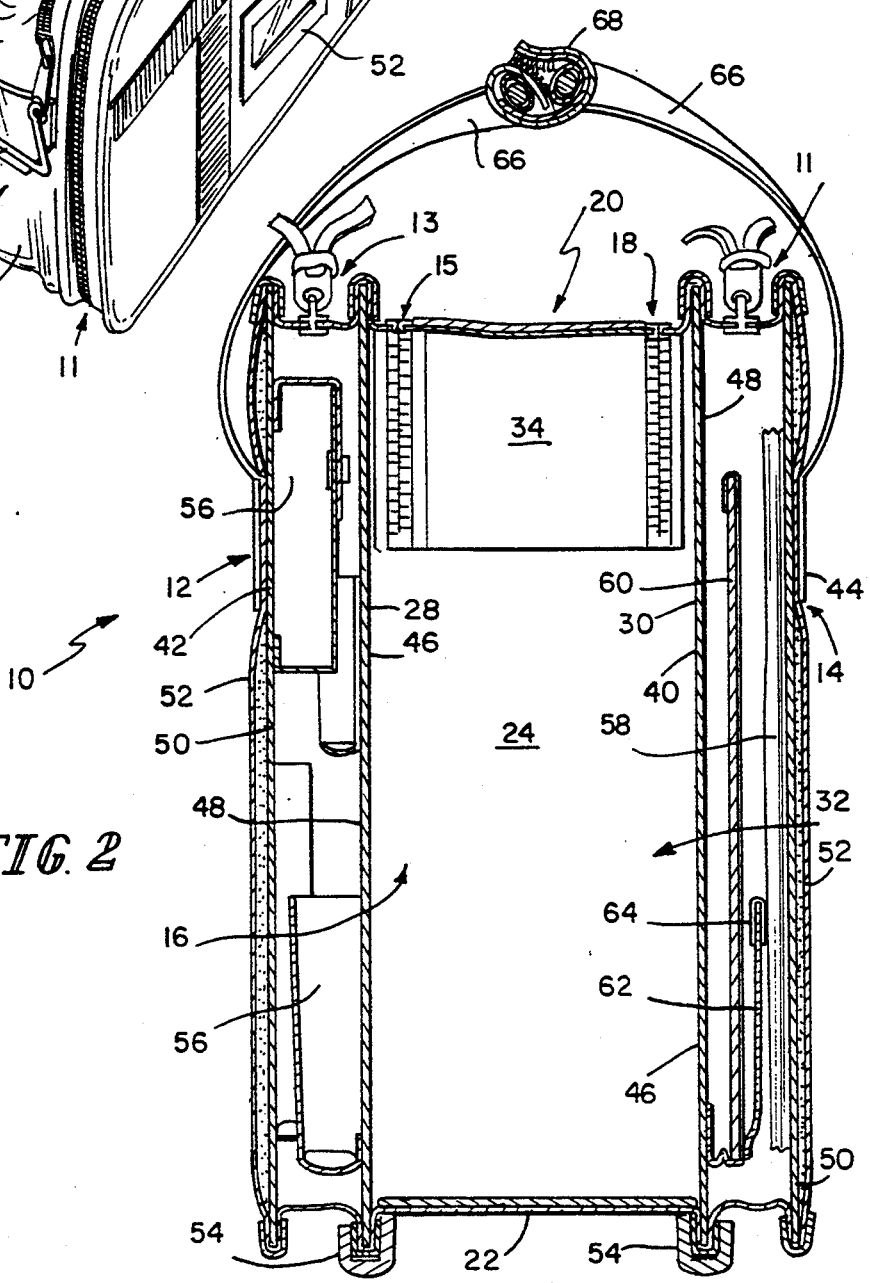
FIG. 2 is a sectional view of the tool case taking along line 2—2 of FIG. 1 showing the central cargo bay and a first and second outer pocket in a closed position.
Figure 3:
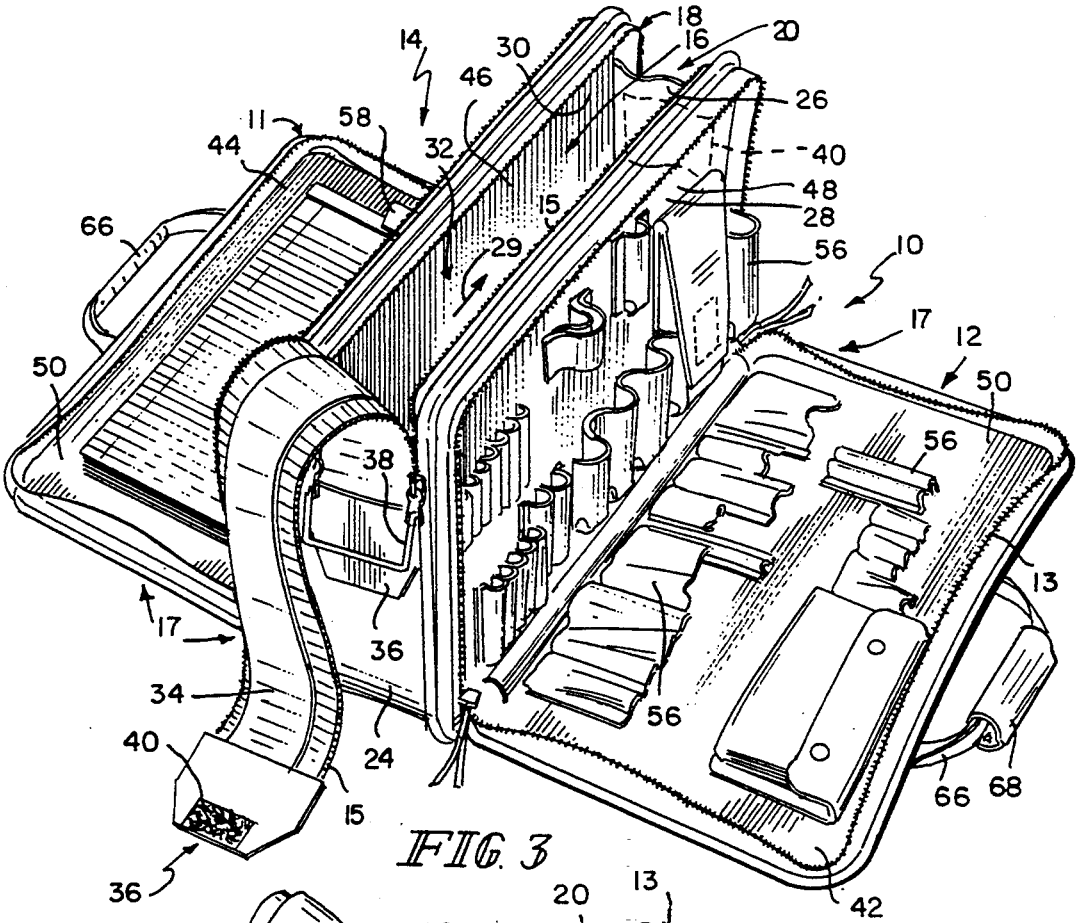
FIG. 3 is a perspective view of the tool case showing the first and second outer pockets in an open position exposing the tool pockets of the first pocket and the field service documentation of the second pocket and the central cargo bay flap in an unfastened position exposing the central cargo bay.

The components of a triple section zipper tool case 10 are shown in FIG. 1. The tool case 10 includes three compartments: a first outer pocket 12, a second outer pocket 14, and a central cargo bay 16 between the first and second outer pockets 12, 14. One advantage of the tool case 10 is that the three compartments 12, 14, 16 can be accessed separately using zippers 11, 13, 15, and 18. The three compartments are shown in an open position 17 in FIG. 3 and a closed position 19 in FIG. 1. Illustratively, the tool case 10 is made of CORDURA ® or similar material such as nylon or vinyl and has a semiflexible construction. The tool case 10 is designed with stability to stand upright even with one or the other or both of the outer pockets 12, 14 in an open position as shown in FIG. 3.

The central cargo bay 16 includes a top side 20, a bottom wall 22 opposite the top side 20, first and second end walls 24, 26 and first and second side walls 28, 30. The end walls 24, 26 and side walls 28, 30 are appended to the bottom wall 22 so that the first and second end walls 24, 26 are opposite one another and the first and second side walls 28, 30 are opposite one another. The area of the side walls 28, 30 is substantially larger than the area of the end walls 24, 26.

The end walls 24, 26, side walls 28, 30, bottom wall 22, and top side 20 define inner area 32 of the central cargo bay 16 that is large and cavernous. Advantageously, the central cargo bay 16 has a large capacity and is arranged to carry cargo in a protected region between the two outer pockets 12 and 14. It also is arranged so that the tool case is not awkward to carry when the cargo bay 16 is full and provides a secure space to eliminate fallout of smaller items.

Figure 4:
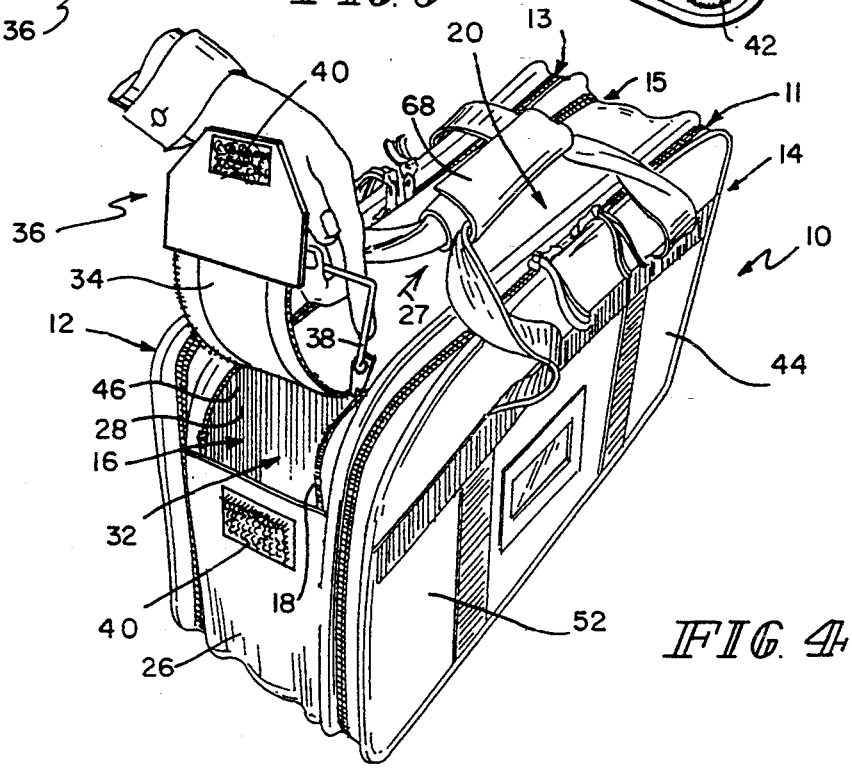
FIG. 4 is a perspective view of the tool case showing the central cargo bay flap being moved from a fastened position to an unfastened position by opening a dual zipper and hook and loop flap fastener.

The top side 20 of central cargo bay 16 is covered by a single central cargo bay flap 34 that extends from the first end wall 24 along the entire length of the top side 20 to the second end wall 26. The flap 34 is fastened and unfastened with a dual zipper hook and loop fastener 36. The fastener 36 includes two zippers 15, 18 situated on opposite sides of the flap 34 that extend along the entire length of the flap 34 from the first end wall 24 along the entire length of the top side 20 to the second end wall 26. The zippers 15, 18 are connected by means of a zipper handle 38. The flap 34 is permanently fastened to the first end wall 24 and is fastened to the second end wall 26 with a hook and loop connector 40. In preferred embodiments of the present invention, the hook and loop connector 40 is a VELCRO ® connector To open the central cargo bay flap 34, the hook and loop connector 40 is unfastened and the dual zipper handle 38 is pulled from the second end wall 26 to the first end wall 24 in direction 27 as shown in FIG. 4. To close the central cargo bay flap 34, the dual zipper handle 38 is pulled from the first end wall 24 to the second end wall 26 in a direction 29 opposite to direction 27 as shown in FIG. 3 and the hook and loop connector 40 is fastened. It will be understood that tool case 10 has been rotated end for end in FIG. 4 (as compared to FIG. 3) to illustrate the hook and loop connector 40 during opening of the single central cargo bay flap 34.

The first and second outer pockets 12, 14 are formed by attaching first and second outside walls 42, 44 to the first and second side walls 28, 30. Each outside wall 42, 44 is permanently appended along the bottom of one of the side walls 28, 30 and is fastened along the other three sides by one of the zippers 11 and 13. Permanently attaching the outside walls 42, 44 to only one side of the central cargo bay 16 allows a wide range of motion for the outer pockets 12, 14 to pivot. This allows for easy access to the two outer pockets 12, 14. Each side wall 28, 30 includes an inner surface 46 facing into the central cargo bay 16 and an outer surface 48 facing into one of the first and second outer pockets 12, 14. Each outside wall 42, 44 includes an inner surface 50 facing toward the central cargo bay 16 when the outer pocket 12, 14 is in the closed position 19 and an outer surface 52 facing away from the central cargo bay 16 when the outer pocket 12, 14 is in the closed position 19.

The relative size of the larger central cargo bay 16 to the smaller outer pockets 12, 14 prevents the tool case 10 from "tipping over" even when the outer pockets 12, 14 are in the open position 17. The tool case 10 is further stabilized by non-skid rubber feet 54 on the bottom of the tool case 10.

The amount of storage space available in the outer pockets 12, 14 is maximized by making the outer pockets 12, 14 extend along the full width and length of the side wall 28, 30 of the central cargo bay 16. The amount of storage space available is also increased by having the outer pockets 12, 14 on the "larger" side walls 28, 30. (The area of the side walls 28, 30 is substantially larger than the area of the end walls 24, 26.)

The first outer pocket 12 is an organized tool case that includes thirty-six super strength NOVALUX TM tool pockets 56. The tool pockets 56 are formed to allow tools (not shown) to slide into the tool pockets 56 and remain fastened in the tool pockets 56 until needed. The tool pockets 56 offer a convenient method of organizing tools (not shown) in the tool case 10 and fastening them in the tool case 10 to prevent the tools (not shown) from banging against each other and becoming unorganized during transport of the tool case 10. The tool case 10 maximizes the number of tools (not shown) that can be carried by providing tool pockets 56 on two surfaces: (1) the outer surface 48 of the first side wall 28 and (2) the inner surface 50 of the first outside wall 42.

The second outer pocket 14 is designed as a slim-line attache case to store and transport necessary field service documentation items such as paper, pens, floppy disks, manuals, etc. . . . (not shown). The second outer pocket 14 includes a built-in clipboard 58 on the inner surface 50 of the second outside wall 44 and a large document pocket 60, two smaller accessory pockets 62, and two pen pockets 64 on the outer surface 48 of the second side wall 30.

In addition to increasing the storage space and versatility of the tool case 10, the outer pockets 12, 14 provide an extra layer of construction to protect items transported in the central cargo bay 16. This added layer of protection provides a more secure space to transport items.

In preferred embodiments, the outside walls 42, 44 are made of DUPONT CORDURA ® PLUS TM on the outer surface 52, tri-wall sandwich on the inner surface 50, and foam padding in between the inner surface 50 and outer surface 52. Also in preferred embodiments, the side walls 28, 30 are comprised of tri-wall sandwich. In alternative embodiments, any suitable material may be used for the outside walls 42, 44 or side walls 28, 30.

The first and second outside walls 42, 44 include handles 66 appended their outer surface 52. The handles 66 can be bound together with a handle wrap 68 as shown in FIG. 4. The tool case 10 can also be carried by a shoulder strap (not shown) attached to tri-rings (not shown) on the outer surface 52 of the outside walls 42, 44.

The triple section tool case 10 offers several advantages. First, each of the central cargo bay 16 and two outer pockets 12, 14 includes its own zippered closures which allows access to each compartment 12, 14, 16 without exposing the contents of the entire tool case 10. Second, the outer pockets 12, 14 maximize the amount of storage space available in the tool case 10 by being appended to the "larger" side walls 28, 30 and being the full width and length of the side walls 28, 30. Third, the first outer pocket 12 is designed to carry tools (not shown), the second outer pocket 14 is designed to carry field service documentation, and the central cargo bay 16 is designed to carry large miscellaneous items such as power tools, notebook computers, circuit boards, space modules, or test equipment. This allows the contents of the tool case 10 to be carried in an organized manner. Fourth, the dual zipper and hook and loop flap fastener 36 allows for easy access to the central cargo bay 16. Fifth, the central cargo bay flap 34 extends from the first end wall 24 along the entire length of the top side 20 to the second end wall 26. This allows for a large area to be opened when accessing the central cargo bay 16. Sixth, the outer pockets 12, 14 pivot freely with respect to the central cargo bay 16 which allows for easy access. Seventh, the outer pockets 12, 14 add an extra layer of construction which provides a more secure space to transport items.

Although this invention has been described in detail with reference to certain embodiments, variations and modifications exist within the scope and spirit of the invention as described and as defined in the following claims.

I claim:

1. A tool case comprising a top side, a bottom wall in spaced apart confronting relation to the top side, first and second end walls appended to the bottom wall and situated to lie in spaced apart confronting relation to one another, the first end wall including a first area and the second end wall including a second area, first and second reinforced side walls appended to the bottom wall and situated to lie in spaced apart confronting relation to one another, the first reinforced side wall being arranged to extend between the first and second end walls and including a first bottom perimeter edge along the bottom wall, a first three-sided perimeter edge along the first end wall, second end wall, and top side, and a third area, the second reinforced side wall being arranged to extend between the first and second end walls and including a second bottom perimeter edge along the bottom wall, a second three-sided perimeter edge along the first end wall, second end wall, and top wall, and a second area, the third and fourth areas being greater than the first and second areas, and the top side, first and second end walls, and first and second side walls cooperating to define a central cargo bay, a first reinforced outside compartment wall appended to the first bottom perimeter edge of the first reinforced side wall, a second reinforced outside compartment wall appended to the second bottom perimeter edge of the second reinforced side wall, the first reinforced outside compartment wall and the first reinforced side wall cooperating to define a first outside compartment and the second reinforced outside compartment wall and the second reinforced side wall cooperating to define a second outside compartment, the first reinformed outside compartment wall including a top edge, first side edge, the second side edge cooperating to define a third three-sided perimeter edge and the second reinforced outside compartment wall including a top edge, first side edge, and second side edge cooperating to define a fourth three-sided perimeter edge, a first fastener joining the first three-sided perimeter edge of the first reinforced side wall to the third three-sided perimeter edge of the first reinforced outside compartment wall, the first fastener being movable along the first three-sided perimeter edge to permit a user to gain access into the first outside compartment and to provide a closure for the first outside compartment, and a second fastener joining the second three-sided perimeter edge of the second reinforced side wall to the fourth reinforced outside compartment wall, the second fastener being movable along the second three-sided perimeter edge to permit a user to gain access into the second outside compartment and to provide a closure for the second outside compartment.

2. A tool case comprising a top side, a bottom wall in spaced apart confronting relation to the top side, first and second end walls appended to the bottom wall and situated to lie in spaced apart confronting relation to one another, the first end wall including a first area, and the second end wall including a second area, first and second reinforced side walls appended to the bottom wall and situated to lie in spaced apart confronting relation to one another, the first reinforced side wall being arranged to extend between the first and second end walls and including a first bottom perimeter edge along the bottom wall, a first three-sided perimeter edge along the first end wall, second end wall, and top side, and a third area, the second reinforced side wall being arranged to extend between the first and second end walls and including a second bottom perimeter edge along the bottom wall, a second three-sided perimeter edge along the first end wall, second end wall, and top wall, and a second area, the third and fourth areas being greater than the first and second areas, and the top side, first and second end walls, and first and second side walls cooperating to define a central cargo bay, a reinforced outside compartment wall appended to the first bottom perimeter edge of the first reinforced side wall, the reinforced outside compartment wall and the first reinforced side wall cooperating to define an outside compartment, the reinforced outside compartment wall including a top edge, first side edge, and second side edge cooperating to define a third three-sided perimeter edge, and a fastener joining the first three-sided perimeter edge of the first reinforced side wall to the third three-sided perimeter edge of the reinforced outside compartment wall, the fastener being movable along the first three-sided perimeter edge to permit a user to gain access into the outside compartment and to provide a closure for the outside compartment.

3. The tool case of claim 2, further comprising:

an outside compartment first end wall substantially co-planar with the first end wall of the central cargo bay, an outside compartment second end wall substantially co-planar with the second end wall of the central cargo bay, and an outside compartment top wall substantially co-planar with the top side of the central cargo bay.

4. The tool case of claim 3, wherein the fastener extends through the outside compartment first end wall, outside compartment second end wall, and outside compartment top wall.

5. The tool case of claim 3, wherein the outside compartment first end wall, outside compartment second end wall, and outside compartment top wall extend between the first three-sided perimeter edge of the first reinforced side wall and the third three-sided perimeter edge of the first reinforced outside compartment wall.

6. The tool case of claim 1, wherein the first and second fasteners are situated between the first and second reinforced outside compartment walls and the central cargo bay

7. The tool case of claim 1, further including a flap to cover the top side and a central cargo bay fastener that is movable to situate the flap between an open position and a closed position.

8. The tool case of claim 7, wherein the central cargo bay fastener includes spaced-apart zippers extending parallel to each other along the sides of the flap and a hook and loop attachment positioned at an end of the flap and arranged to connect the end of the flap to the tool case.

9. The tool case of claim 8, wherein the flap in its closed position extends from a position on the first end wall between the top side and bottom wall up the first end wall toward the top side then along the top side to the second wall and down the second end wall to a position between the top side and bottom wall.

10. The tool case of claim 1, wherein the first and second reinforced side walls include an inner surface facing into the central cargo bay and an outer surface facing into one of the first and second outside compartments.

11. The tool case of claim 10 wherein the first and second reinforced outside compartment walls pivot with respect to the first and second reinforced side walls.

12. The tool case of claim 10, wherein at least one of the first and second reinforced outside compartment walls and corresponding reinforced side wall include tool pockets formed to hold tools.

13. The tool case of claim 10, further including handles situated on the first and second reinforced outside compartment walls.

14. The tool case of claim 1, wherein the tool case is soft-sided.

15. The tool case of claim 2, wherein the location and attachment of the bottom, first and second end wall, first and second side walls provides means for stabilizing the tool case when the outside compartment is in an open position.

16. The tool case of claim 15, further comprising an outside compartment bottom wall substantially co-planer with the bottom wall of the central cargo bay, the bottom wall of the central cargo bay defines a first fifth area and the outside compartment bottom wall defines a sixth area, and wherein the fifth area is substantially larger than the sixth area.

17. The tool case of claim 2, wherein the reinforced outside compartment wall includes an extra layer of construction for protecting the contents of the central cargo bay.

18. The tool case of claim 2, further comprising a flap extending from the first end wall along the top side to the second end wall, the flap includes means for fastening so that the flap can be positioned in one of an open and closed position.

19. The tool case of claim 18, wherein means the for fastening includes spaced-apart zippers extending parallel to each other along the sides of the flap and a hook and loop fastener positioned at an end of the flap and arranged to fasten the flap to the tool case.

* * * * *